United States Patent [19]

Schmidt

[11] 4,309,845

[45] Jan. 12, 1982

[54] THERMALLY INSULATED HINGED WINDOWS AND DOORS

[75] Inventor: Dietrich F. Schmidt, Carlisle, Pa.

[73] Assignee: Capitol Products Corporation, Mechanicsburg, Pa.

[21] Appl. No.: 903,505

[22] Filed: May 8, 1978

Related U.S. Application Data

[63] Continuation of Ser. No. 751,046, Dec. 14, 1976.

[51] Int. Cl.[3] ..... E06B 3/00

[52] U.S. Cl. ..... 49/501; 49/DIG. 1

[58] Field of Search ..... 49/401, 501, 484, 404, 49/DIG. 1

[56] References Cited

U.S. PATENT DOCUMENTS

| | | | |
|---|---|---|---|
| 3,077,250 | 2/1963 | Goldberg | 49/484 |
| 3,308,582 | 3/1967 | Bakke | 49/401 X |
| 3,462,884 | 8/1969 | Bissoniere | 49/404 |

FOREIGN PATENT DOCUMENTS

| | | | |
|---|---|---|---|
| 723923 | 12/1965 | Canada | 49/484 |
| 299285 | 8/1965 | Netherlands | 49/484 |

*Primary Examiner*—Kenneth Downey

*Attorney, Agent, or Firm*—Donald L. Johnson; John F. Sieberth; Paul H. Leonard

[57] ABSTRACT

A thermally insulated hinged window or door having a sash rail with a metal frame around the periphery thereof which is shielded from exposure to interior or exterior ambient temperatures by an extended overlapping frame member and seal to the glazing gasket perimeter.

5 Claims, 4 Drawing Figures

THERMALLY INSULATED HINGED WINDOWS AND DOORS

This is a continuation of application Ser. No. 751,046, filed on Dec. 14, 1976.

BACKGROUND TO THE INVENTION

The present invention is in the building construction field and relates to windows and doors, particularly hinged windows and doors employing insulated glass panels. The invention is applicable to top hung, out-opening—bottom hung, in-opening—casement, in or out-opening—top hinged, in-opening, windows or doors.

The invention particularly relates to thermally insulated hinged windows or doors and similar panel assemblies for installation in a rough opening of an enclosed wall exposed to different temperature conditions at the opposite sides thereof.

The relatively high thermal conductivity of metals, such as aluminum or alloys thereof, is probably the most undesirable property limiting their substitution for wood and other less conductive non-metallic structural materials. The effect of this metal characteristic is best seen in windows or doors or other panel assemblies employing metal framing in direct conductive relationship with air at interior and exterior ambient temperatures giving rise to the generation and presence of frost and moisture condensation on the interior surfaces of the framing, especially in climates where extreme temperature differentials prevail. When a panel assembly has a metal outer frame fixed in the rough opening of a wall, and a sash movably mounted in such fixed outer frame with a metal frame peripherally embracing a glass or other panel, the thermal conductivity problem exists with respect to the metal sash frame as well as the metal outer or fixed frame.

A wide variety of solutions to overcome the deleterious high thermal conductivity of metal framing for windows, doors, and similar panel assemblies have been proposed with varying degrees of success. Most of the prior art constructions have included some type of thermal break or insulating barrier installed in an appropriate part of the outer metal frame and also in an appropriate part of the sash frame. Such constructions are often complex and difficult to fabricate as well as being relatively expensive. Examples of typical thermal barrier window or door assemblies or constructions may be found in U.S. Pat. Nos. 24,704; 3,055,648; 3,289,377; 3,302,354; 3,332,184; 3,393,487; 3,411,254; 3,420,026; 3,462,884; 3,487,580; 3,530,618; 3,600,857; and 3,780,473. As can readily be seen, thernal barrier constructions are made in numerous shapes and configurations and most require rather sophisticated fabrication.

Examples of hinged window constructions are illustrated by U.S. Pat. Nos. 3,686,795; 3,878,648; and 3,861,085. The first patent is of the thermally insulated casement type and utilizes several complex plastic and metal shapes to provide thermal insulation. The second patent discloses a structure designed to produce a frame concealed operating sash of increased strength, but does not provide thermal insulation between interior and exterior ambient temperatures. The third patent also relates to casement type windows and discloses a particular type of glazing construction as well as one type of thermal barrier. All of these constructions are difficult to fabricate.

It is a primary object of the present invention to provide a thermally insulated hinged type window, door or other panel of such construction that the outer frame overlaps the sash or panel to avoid exposure of the sash rail to either interior or exterior conditions and eliminates the need for a thermo-break or thermally insulated sash rail.

An important object of the instant invention is to provide a thermally insulated hinged window, door or the like, which has improved structural strength and which can be fabricated more economically.

Other objects and advantages of the invention will become readily apparent from a consideration of the description and drawings hereinafter.

SUMMARY OF THE INVENTION

The present invention includes a thermally insulated metal hinged window or door or like panel assembly wherein metal sash rails of an insulated glass panel are shielded from exposure to interior and exterior ambient temperatures by extending an overlapping thermally insulated frame member and seal to the glazing gasket perimeter. Such construction eliminates a thermal barrier or thermo-break in the sash rail. The invention is applicable to hinged assemblies of the in and out panel type, namely casements, projected types, and top and bottom hung types.

BRIEF DESCRIPTION OF THE DRAWINGS

The foregoing and other aspects and advantages of the present invention will become more readily apparent to those skilled in the art upon a full understanding of the preferred embodiments of the invention shown in the accompanying drawings wherein.

DESCRIPTION OF THE PREFERRED EMBODIMENT

The window, door or like panel assembly of the present invention is adapted for installation in a rough opening of a wall in a building, house, or like construction. The panel assembly is particularly adapted for use with an insulated glass panel. The window assembly is of the hinged type and may be top hung with an out-opening, bottom hung with an in-opening, top hinged with an in-opening, or casement with an in or out-opening, or other suitable hinged type window construction. The assembly includes a single insulated glass panel which is hingedly moved in or out.

Figure 1:
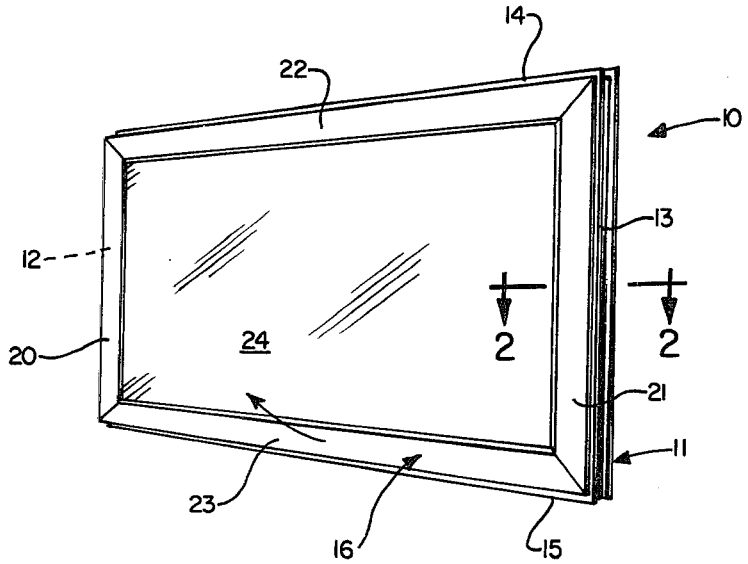
FIG. 1 is a perspective view of the exterior side of a window assembly embodying this invention.

Referring now to the drawings, especially FIG. 1, a top hung, out-opening window as viewed from the exterior is generally illustrated at 10 and incorporates an outer frame 11 which comprises side jambs 12 (not seen in FIG. 1) and 13, connected to a header 14 and a sill 13. The side jambs, head and sill are preferably made of an extruded aluminum or aluminum alloy. The various frame parts are mitered and held together in a conventional manner using screws or other suitable fasteners. An insulated glass panel 16 is hingedly mounted in the frame 11. The insulated glass panel includes side rails 20 and 21, top rail 22, bottom rail 23, and glass panels 24 and 25 mounted within the rails. The glass panel 16 is hingedly mounted in the frame 11 in any suitable manner. A standard four-bar hinge is suitable. For simplification of the drawings, the hinged construction or hinge mechanism is not shown.

Figure 2:
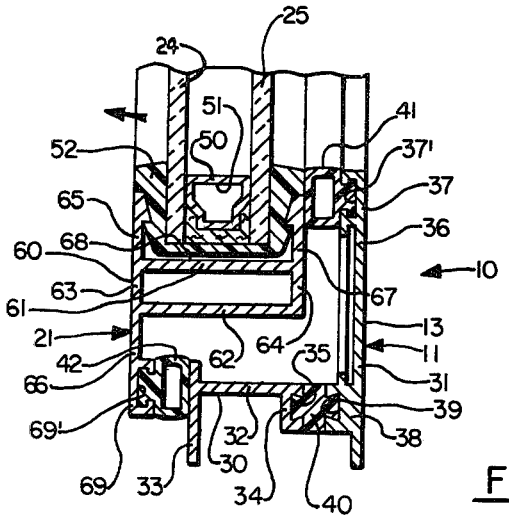
FIG. 2 is an enlarged sectional view taken along line 2—2 of FIG. 1.

The header, sill and jambs, or window frame members are so constructed as to provide a suitable track or recessed area for the window panel. The frame members are of the thermal barrier or thermo-break type. The insulating barrier in the frame members may be of any suitable type. Details of the window 10 are more clearly seen in FIG. 2. The header, sill and jambs of the window frame 11 are similarly constructed.

Side jamb 13 includes an outer metal member 30 and an inner metal member 31 joined together and separated by an insulating barrier 40. Outer metal member 13 comprises a main or central member 32 with a flange 33 on the exterior end thereof and a leg 34 on the interior end thereof. Leg 34 has a dove-tailed channel 35 constructed therein for receiving a similarly constructed portion of the thermal barrier 40. Inner metal member 31 comprises a main member 36 having a somewhat "C"-shaped projection 37 on one end thereof and a somewhat thickened portion 38 on the other end thereof. A dove-tailed channel 39 is formed in the thickened portion 38 for receiving a similarly constructed portion of insulator 40. Projection 37 has a "T"-shaped channel therein for receiving one end of a sash perimeter seal or insulator 41 therein. Outer metal member 30 and inner metal member 31 are so joined together that the main members of each, 32 and 36 are at right angles to each other. The members 30 and 31 more or less provide a recessed area for the panel 16.

The insulated glass panel 16 can also be constructed in a variety of ways. The illustrated panel is merely one example of a type suitable for use with the present invention. Panel 16 includes a pair of glass panels 24 and 25 which are separated by longitudinally extending spacer 50. Normally a desiccant is placed in the opening 51 of the spacer 50. The spacer can be constructed in numerous ways and is normally made of metal or other suitable material. The "U"-shaped glazing gasket 52 is positioned externally around the edges of glass panels 24 and 25. A suitable sealant such as a polysulfide or other suitable material is placed in the space between the metal spacers and the gasket and assures complete sealing of the space between the panels 24 and 25 from the exterior.

Side rail or stile 21 is a one-piece metal member and comprises a rectangular frame 60 made up of long members 61 and 62 and short members 63 and 64. A leg 65 extends from one end of the short leg 63 and a leg 66 extends from the other end of the short leg 63. Additionally, a leg 67 extends from the short leg 64 and is parallel to the leg 65. Legs 65 and 67 along with long member 61 form a channel 68 for receiving the glazing gasket 52. The legs 65 and 67 and the glazing gasket 52 are so constructed that the legs 65 and 67 sealedly engage the glazing gasket 52. A somewhat "C"-shaped projection 69 is formed on leg 66 and has a channel 69' therein for receiving a similarly shaped portion of perimeter seal 42. Perimeter seals 41 and 42 provide thermal insulation of the panel 16 from the frame 11. The seals or insulators may be an extruded PVC, neoprene or cellular neoprene or any other suitable material.

Side rail 20, top rail 22 and bottom rail 23 are constructed or shaped similarly to side rail 21. The top and bottom rails and two side rails provide a metal frame around the periphery of the insulated glass panel. With each rail being a one-piece metal member, the panel frame is a continuous one, i.e., no thermal barrier or thermo-break is constructed in the panel frame. The particular construction of the panel frame, i.e., the rails, in conjunction with the perimeter seals and window frame construction provides a structurally strong thermally insulated window.

Figure 3:
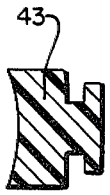
FIG. 3 is a sectional view of an alternate embodiment of a perimeter seal or insulator of this invention.
Figure 4:
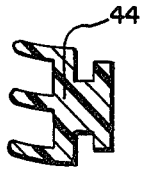
FIG. 4 is a sectional view of still another embodiment of a perimeter seal or insulator of this invention.

A cross-section of an alternately shaped sash perimeter seal 43 is illustrated in FIG. 3. A cross-section of another embodiment of a sash perimeter seal 44 is illustrated in FIG. 4. Seals 43 and 44 are representative of alternate embodiments of seals 41 and 42 and may be substituted therefor. It can be appreciated that such seals can be constructed in a variety of shapes and configurations. It is important, however, that such seals provide a complete thermal barrier between the frame 11 and the panel 16. As illustrated, seal 41 is mounted on the window frame and seal 42 is mounted on the panel sash frame. It can be appreciated that the seals can be mounted both on the window frame or both on the glass panel frame or one on each. The illustrated construction is believed to be the more preferred because of its relative simplicity.

When the window is closed or in a closed position as illustrated, perimeter seal 41 seals the inner metal frame member 31 from the window panel frame. Perimeter seal 42 seals the outer metal frame member 30 from the window panel frame. Since the member 30 is exposed to exterior conditions, thermal barrier 40 in the window frame provides the necessary thermal insulation between exterior and interior ambient conditions.

It can be appreciated that thermal barrier 40 can be constructed in any other suitable manner and that the type of thermo-break or thermal barrier frame construction shown is merely illustrative. The thermal barrier may be made of plastic or other suitable insulating material.

The present invention provides a thermally insulated hinged type metal window, door or other suitable panel; one which is relatively simple in design and which can be readily and easily fabricated. Such construction provides a marked improvement in thermally insulated panel constructions of the hinged type.

The foregoing disclosure and description of the invention is merely illustrative thereof and variations in the size, shape and materials as well as in the details of the illustrated constructions, may be made within the scope of the appended claims without departing from the spirit of the invention.

What is claimed is:

1. A hinged window, door or like panel assembly, comprising an outer frame including interior and exterior metal members separated and joined together by a thermal barrier member, an outwardly movable insulated glass panel having a continuous metal frame around the periphery thereof mounted in said outer frame, said continuous metal frame including a top rail, a bottom rail and a pair of side rails, each of said rails being one-piece metal members, a first perimeter seal means for thermally insulating the interior metal outer frame member from the metal panel frame and a second perimeter seal means for thermally insulating the exterior metal outer frame member from the metal panel frame, said first perimeter seal means being mounted or positioned on the exterior side of one end of the interior metal member of the outer frame, each of said rails of said metal frame around the periphery of the insulated glass panel having a leg extending outwardly therefrom and said second perimeter seal means being mounted or positioned on the interior side of one end of said outwardly extending leg.

2. The window, door or like panel assembly of claim 1, wherein said perimeter seal means are one-piece plastic members having a longitudinally extending opening therethrough.

3. The window, door or like panel assembly of claim 3, wherein said perimeter seal means are one-piece plastic members having a depressable curved face (as seen in cross-section) on one edge thereof.

4. The window, door or like panel assembly of claim 1, wherein said perimeter seal means are one-piece plastic members having a plurality of flexible fingers (as seen in cross-section) on one edge thereof.

5. The window, door or like panel assembly of claim 1, wherein each of said one-piece metal rails comprises a rectangular frame having a pair of long members and a pair of short members, a pair of legs extending inwardly from each of said short members and parallel with each other, and another leg extending outwardly from one of said short members for receiving said second perimeter seal means.

* * * * *